United States Patent [19]

Gabrius et al.

[11] 4,406,457

[45] Sep. 27, 1983

[54] METHOD OF AND APPARATUS FOR MOUNTING PLAYFIELD WINDOW

[75] Inventors: Algimantis J. Gabrius, Carol Stream; John W. Buras, Chicago, both of Ill.

[73] Assignee: D. Gottlieb & Co., Northlake, Ill.

[21] Appl. No.: 288,924

[22] Filed: Jul. 31, 1981

[51] Int. Cl.[3] ..... A63D 3/02; B23P 19/00

[52] U.S. Cl. ..... 273/121 A; 220/327; 220/377; 29/526 R

[58] Field of Search ..... 29/526 R; 273/121 A, 273/123 A, 118 A, 120 A, 119 A, 122 A; 220/377, 378, 327

[56] References Cited

U.S. PATENT DOCUMENTS

| | | | |
|---|---|---|---|
| 1,925,999 | 9/1933 | De Giers | 220/377 X |
| 2,517,012 | 8/1950 | Miller | 220/327 |
| 2,637,804 | 5/1953 | Hollins | 220/327 X |
| 2,750,069 | 6/1956 | Gross | 220/327 |
| 3,897,951 | 8/1975 | Morrison et al. | 273/121 A |
| 4,059,199 | 11/1977 | Quaney | 220/327 X |
| 4,206,499 | 6/1980 | Urbanek | 220/327 X |

FOREIGN PATENT DOCUMENTS

| | | | |
|---|---|---|---|
| 518658 | 2/1931 | Fed. Rep. of Germany | 220/327 |
| 1422335 | 11/1965 | France | 273/121 A |
| 180965 | 6/1922 | United Kingdom | 220/327 |

*Primary Examiner*—Charlie T. Moon

*Attorney, Agent, or Firm*—Arnold, White & Durkee

[57] ABSTRACT

A pinball machine having multi-level playfields with a transparent window mounted in at least an upper level playfield to allow observation therethrough to a lower level playfield. The window is mounted on a ledge in an opening in the upper level playfield with compressible rings and screws extending through the window, rings and ledge to compress said rings until the window is in the same plane as said playfield.

8 Claims, 3 Drawing Figures

METHOD OF AND APPARATUS FOR MOUNTING PLAYFIELD WINDOW

BACKGROUND OF THE INVENTION

1. Field of the Invention

The present invention relates to a method of mounting a window in the surface of a pinball playfield.

2. Description of the Prior Art

Designers of pinball games constantly strive to provide innovations to the game to continue the interest in playing pinball. For example, new drop-target and rollover switch designs and new game strategies in general have been developed for attracting players and continuing the high interest in pinball.

There have been recent proposals to innovate the playfield itself in an attempt to provide new attractions to the pinball player. Pinball games having conical playfields, rather than a traditional planar playfield, have been suggested. Multi-level playfields have also been suggested, for example, as shown in U.S. Pat. Application No. 277,324, filed June 25, 1981. In such multilevel games, there is an upper playfield and a lower playfield, each of which includes flippers for propelling the ball on the playfield and ball-actuated devices which the ball may engage. Play of such games commences with the ball on the upper playfield, and the ball may be transferred to the lower playfield. Play then continues in the lower playfield.

In such dual level games, the upper playfield may be designed to allow viewing of play in the lower playfield. To this end, a portion of the upper playfield may include a window comprised preferably of a relatively thin, transparent material such as a pane of plexiglas. The pane may be tinted to facilitate viewing of the lower playfield and to reduce glare.

In pinball, the playfield preferably has a smooth surface on which the ball rolls. Accordingly, the window should be installed on the upper playfield in such a manner that the upper playfield forms a continuous, unbroken surface. In other words, the window should be mounted such that one surface is flush with the remainder of the playfield. Otherwise, the playfield surface will not be smooth and the ball will move eratically on the upper playfield whenever it encounters a point at which the window and the remainder of the playfield meet. Even the slightest discontinuity may influence ball motion.

SUMMARY OF THE INVENTION

In accordance with the present invention, a method and apparatus are provided for mounting a window on a playfield, such that the elevation of one surface thereof is adjustable with respect to the remaining surface of the playfield, preferably to achieve flush surfaces.

According to the invention, an opening is formed in the playfield for receiving the window. A ledge is formed on the underside of the playfield surface around the periphery of the opening formed in the playfield, and the ledge extends partially into the opening. Holes are then formed at a plurality of locations in the window and at corresponding locations in the ledge. A compressible material which preferably takes the form of washer-shaped grommets, is then placed at various locations on the ledge. Preferably, such grommets are located at the hole locations. The window is then placed on top of the compressible material. At this time, the upper surface of the window is slightly elevated from the remainder of the playfield.

Securing devices, e.g. screws, are then inserted into the holes. As the screws are tightened, they engage the ledge, and the compressible material is compressed. Tightening of the screws continues until the upper surface of the window is brought flush with the remainder of the playfield, or otherwise is brought to achieve the desired elevational relationship between the surfaces.

BRIEF DESCRIPTION OF THE DRAWINGS

The advantages and features of the present invention will become apparent from a reading of the following detailed description, when read in conjunction with the accompanying drawings, wherein.

DETAILED DESCRIPTION OF A SPECIFIC EMBODIMENT

It will be appreciated that the present invention can take many forms and embodiments. One embodiment is described herein to give an understanding of the invention. It should be understood that the following description is intended to be illustrative, and not limiting, of the invention.

Figure 1:
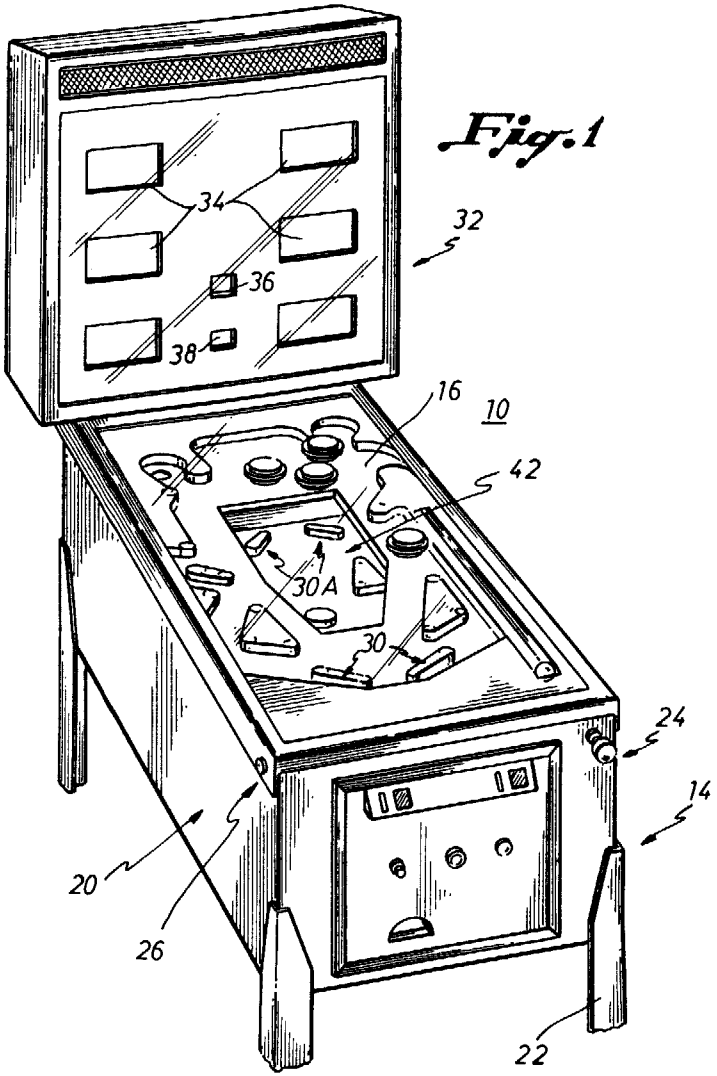
FIG. 1 is a perspective view of a dual level pinball game.

Referring now to FIG. 1, a dual level pinball game 10 is illustrated. The pinball game 10 has a lower playfield 12 which lies in a plane sloped away from the usual player position 14 for a pinball game. The pinball game 10 also has an upper playfield 16 having a traditional slope towards the player position 14. The playfield 12 will be referred to herein as the lower playfield, and the playfield 16 will be referred to as the primary playfield.

The pinball game 10 includes the conventional pinball elements. A cabinet 20 is provided for supporting the playfields 12, 16 using conventional hinges and other brackets. The primary playfield 16 is conventionally hinged at the end distant from the player. A set of supporting legs 22 is provided for elevating the cabinet 20 to a height convenient to the pinball player. A plunger or shooter 24, and a set of flipper control switches 26 are disposed on the cabinet 20 near the player position 14. Sets of thumper bumpers 28, flipper mechanisms 30, and other ball propelling devices such as slingshots, etc. are disposed in a conventional manner on the primary playfield 16. A conventional solenoid-operated out-hole (not shown) is provided to return the ball to the shooter 24 when this ball is lost in play between the flipper mechanisms 30 or when the ball is returned from the lower playfield 12.

A back glass assembly 32 is supported at the end of the cabinet 20 opposite the player position 14. The back glass assembly 32 has the usual pinball assemblies such as scoring displays 34, a game tally display 36, and ball-in-play display 38.

Disposed on the lower playfield 12 are the usual thumper bumpers (not shown), flipper mechanisms 30A and other ball propelling apparatus. Operation of the ball propelling elements on the lower playfield 12 causes scoring on the displays 34 in a conventional manner. As seen from FIG. 1, the flipper mechanisms 30, 30A are disposed to propel the ball in planes of opposite slope during play. The flipper mechanism 30A actively propels the ball towards the player position 14 after the ball has rolled downwardly away from the position 14 towards the mechanism 30.

The playfields 12, 16 are designed to allow them to be confined in a conventional pinball cabinet and yet provide space for one or more ball transfer mechanisms 40 which allow transfer of the ball from one playfield to the other.

The playfield 16 is specially designed to allow viewing of the lower playfield 12. To this end, one or more windows are provided in the primary playfield 16. In the illustrated embodiment a single window 42 is shown. The window preferably comprises a relatively flat, generally transparent material such as a pane of plexiglas. As a matter of preference, the window may be tinted to facilitate viewing of the underlying playfield 12 and to reduce glare.

In order to minimize the disturbance of the roll of the ball during play, the window 42 preferably lies in the plane of the primary playfield 16. In other words, the upper surface of the window 42 should be flush with primary playfield 16. The method and apparatus of the present invention provide such result.

Figure 2:
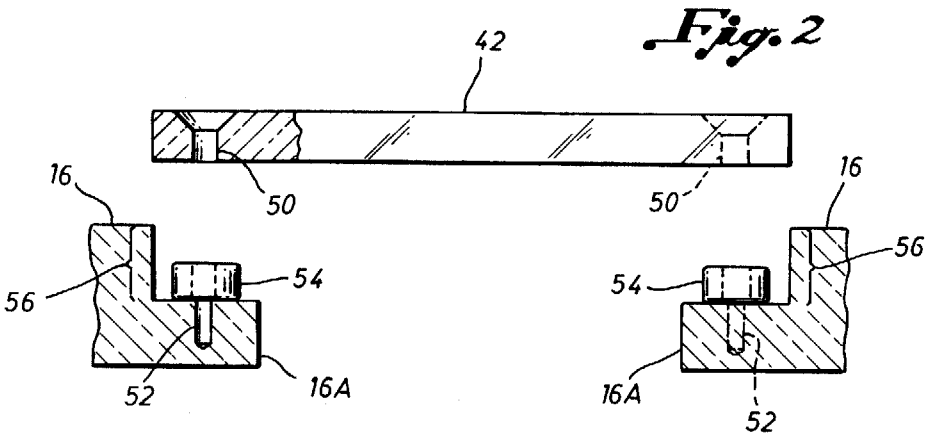
FIG. 2 is a cross-sectional view of the upper playfield and playfield window of FIG. 1, which illustrates the present invention.

With reference now to FIG. 2, there is illustrated a cross-sectional view of the primary playfield 16 and the window 42. Protruding from the lower side of the playfield 16 in the opening to receive the window 42 are ledges 16A. The ledge 16A may be formed by notching the upper portion of the playfield 16, as shown, or by suitably attaching another piece of material to the underside of the playfield 16.

A plurality of holes 50 are formed around the outer edges of the window 42, and the holes 50 are preferably countersunk as shown. A plurality of holes 52 having respectively the same centers as the holes 50 are formed in the ledges 16A. As will become apparent from the following, the holes 52 are preferably smaller in diameter than the holes 50.

Atop each hole 52 is placed a grommet 54, which is made of a compressible material. Preferably, each grommet 54 is made of an open cell, neoprene sponge rubber of medium density. This has proven to provide outstanding results. Further, each grommet 54 includes pressure sensitive adhesive on the side which is placed in contact with ledge 16A.

Each grommet 54 is washer-shaped and has a hole formed in its center. In a preferred embodiment, each grommet 54 has an outer diameter of ½ inch and has a 3/16 inch diameter hole formed in its center. The thickness of each grommet 54 is preferably ¼ inch.

The window 42 is then mounted in the opening in the playfield 16 as follows. The window 42 is placed on top of the grommets 54. Since the sum of the thicknesses of the window 42 and the grommets 54 exceeds the height 56, the upper surface of the window 42 is not flush with the playfield 16 at this time.

Figure 3:
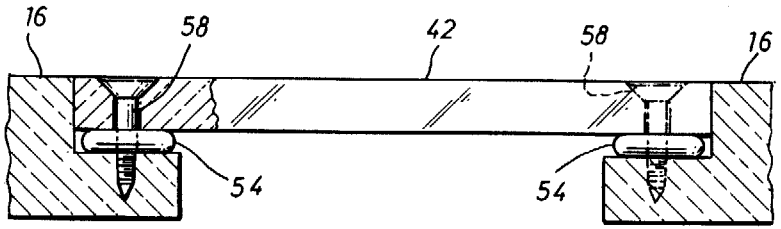
FIG. 3 is a cross-sectional view of the upper playfield and playfield window of FIG. 1, which also illustrates the present invention.

Suitable securing means, for example, screws 58, are then inserted through the holes 50 and the holes in the grommets 54. The screws 58 are then tightened down, which causes the threaded poriton thereof to engage the material of ledges 16A. As each screw 58 is tightened, the respective grommet 54 is compressed as shown in FIG. 3. The tightening of screws 58 continues until the upper surface of the pane 44 is brought flush with the playfield 16.

From the foregoing, it is seen that a simple, yet very accurate, method of, and apparatus for, mounting the window 42 in the plane of the playfield 16 is realized.

What is claimed is:

1. A method of mounting a window in a pinball playfield so that the window is flush with the playfield, comprising the steps of:
   (a) forming an opening in the playfield to receive the window;
   (b) establishing a ledge around the periphery of the opening on the underside of the playfield;
   (c) placing a compressible material at selected locations on the ledge; and
   (d) securing the window to the ledge with adjustable fasteners while compressing the compressible material until the window and the playfield lie in substantially the same plane.

2. The method of claim 1, wherein the step (d) comprises the steps of:
   (a) forming a plurality of holes in the window near the outer periphery thereof;
   (b) forming a plurality of holes in the ledge and in the compressible material at locations corresponding to the locations of the holes in the window; and
   (c) inserting screws through the openings in the window and tightening the screws to engage the holes in the ledge, the tightening of the screws causing the compressible material to compress.

3. A method of mounting a window to be flush with a pinball playfield, comprising the steps of:
   (a) forming an opening in the playfield for the window;
   (b) establishing a ledge around the periphery of the opening on the underside of the playfield;
   (c) forming a plurality of holes in the window near the outer periphery thereof;
   (d) forming a plurality of holes in the ledge at locations corresponding to the locations of the holes in the window;
   (e) placing a washer-shaped grommet on top of each hole in the ledge, the grommets being made of a compressible material;
   (f) placing the window on top of the grommets;
   (g) inserting a screw in each hole formed in the window; and
   (h) tightening each screw to engage it with the ledge, the tightening of the screw causing its corresponding grommet to compress until the window and playfield are in substantially the same plane.

4. A method of mounting a window which is at least partially transparent in a pinball playfield having an opening for receiving the window and a ledge around the periphery of the opening on the underside of the playfield, comprising the steps of:
   (a) supporting a compressible material at selected locations on the ledge; and
   (b) securing the window to the ledge with adjustable fasteners while compressing the compressible material until the window and the playfield lie in substantially the same plane.

5. The method of claim 4, wherein the step (b) comprises the steps of:
   (a) forming a plurality of holes in the window near the outer periphery thereof;
   (b) forming a plurality of holes in the ledge and in the compressible material at locations corresponding to the locations of the holes in the window; and (c) inserting screws through the openings in the window and tightening the screws to engage the holes in the ledge, the tightening of the screws causing the compressible material to compress.

6. A method of mounting a window in a pinball playfield having an opening for receiving the window and a ledge around the periphery of the opening on the underside of the playfield, comprising the steps of:

(a) forming a plurality of holes in the window near the outer periphery thereof;

(b) forming a plurality of holes in the ledge at locations corresponding to the locations of the holes in the window;

(c) placing a washer-shaped grommet on top of each hole in the ledge, the grommets being made of a compressible material;

(d) placing the window on top of the grommets;

(e) inserting a screw in each hole formed in the window; and (f) tightening each screw to engage it with the ledge, the tightening of the screw causing its corresponding grommet to compress until the window and playfield are in substantially the same plane.

7. A pinball game having a playfield with a window mounted in an opening therein, comprising:

(a) a playfield having an opening formed therein;

(b) a ledge around the periphery of the opening on the underside of the playfield;

(c) a compressible material which is disposed at selected locations on the ledge;

(d) a window inserted into the hole in the playfield; and (e) adjustable fasteners securing the window to the ledge with the compressible material compressed until the window and the playfield lie in substantially the same plane.

8. A pinball game having a playfield with a window mounted in an opening therein, comprising:

(a) a playfield having an opening formed therein;

(b) a window inserted into the opening in the playfield, said window having a plurality of holes formed in the periphery thereof;

(c) a ledge on the underside of the playfield around the periphery of the opening in the playfield, said ledge having holes formed therein which correspond to the holes in the window;

(d) a plurality of washer-shaped grommets between the window and the ledge, each said grommet being placed on top of each hole in the ledge, each grommet being made of a compressible material; and (e) a plurality of screws, one for each hole in the window, which are tightened, whereby the compressible grommets compress until the window and playfield lie in substantially the same plane.

* * * * *